United States Patent [19]

Turner

[11] 4,449,762

[45] May 22, 1984

[54] COMPUTER DESK

[76] Inventor: Jeffrey A. Turner, 2901 W. Laurel La., Phoenix, Ariz. 85029

[21] Appl. No.: 246,143

[22] Filed: Mar. 23, 1981

[51] Int. Cl.[3] ..... A47B 21/00; G06C 7/02

[52] U.S. Cl. ..... 312/196; 312/194; 312/208; 235/146; 108/92

[58] Field of Search ..... 312/196, 194, 195, 208, 312/107; 108/25, 92, 97; D6/161; 235/146

[56] References Cited

U.S. PATENT DOCUMENTS

| | | | |
|---|---|---|---|
| D. 57,075 | 2/1921 | Fox | D6/161 |
| D. 90,710 | 9/1933 | Goodman | 108/25 |
| D. 161,959 | 2/1951 | Park | D6/161 |
| D. 165,707 | 1/1952 | Buehler | 312/194 |
| D. 249,211 | 9/1978 | Wright et al. | D6/161 |
| D. 258,736 | 3/1981 | Genaro et al. | D6/161 |
| 928,185 | 7/1909 | Dey | 312/194 |
| 1,585,102 | 5/1926 | Langdon | 312/107 |
| 1,827,128 | 10/1931 | Wege | 108/92 |
| 1,849,726 | 3/1932 | Reed | 312/194 |
| 2,242,745 | 5/1941 | Coxhead | 312/208 |
| 2,499,713 | 3/1950 | Bargen | 312/208 |
| 2,708,524 | 5/1955 | Kerr | 108/25 |
| 2,793,926 | 5/1957 | Deaton | 312/194 |
| 2,893,533 | 7/1959 | Childs | 312/208 |
| 3,034,841 | 5/1962 | Blevins | 108/92 |
| 3,338,647 | 8/1967 | Schreyer | 108/92 |
| 3,366,415 | 1/1968 | Cooper | 108/25 |
| 3,778,125 | 12/1973 | Gutmann, Jr. et al. | 312/196 |
| 3,979,156 | 9/1976 | Gross | 312/196 |
| 4,062,606 | 12/1977 | Peets | 312/208 |
| 4,066,305 | 1/1978 | Gazarek | 312/195 |
| 4,313,112 | 1/1982 | Foster | 312/196 |
| 4,316,082 | 2/1982 | Fritz | 312/208 |
| 4,345,803 | 8/1982 | Heck | 312/194 |

FOREIGN PATENT DOCUMENTS

| | | | |
|---|---|---|---|
| 1371129 | 7/1964 | France | 312/195 |

*Primary Examiner*—Victor N. Sakran
*Attorney, Agent, or Firm*—James F. Duffy

[57] ABSTRACT

A computer desk may be utilized with computer keyboard terminal equipment or other devices requiring manual manipulation by a user. The desk permits the efficient support of such devices without sacrifice of the desk top working surface available to the user. The computer desk provides a support surface immediately below the work surface of the desk top. This support surface extends toward the desk-user a greater distance than does the desk top work surface. Thus, there is no interference between the desk top work surface and the user's access to equipment emplaced upon the support surface. An extension of the support surface to the side provides additional support areas for associated computer devices or the like without sacrifice of desk top work surface area. Storage areas beneath the desk top work surface and the support surface are provided to store materials and devices of use to a user of the computer desk.

8 Claims, 5 Drawing Figures

FIG. 1
PRIOR ART
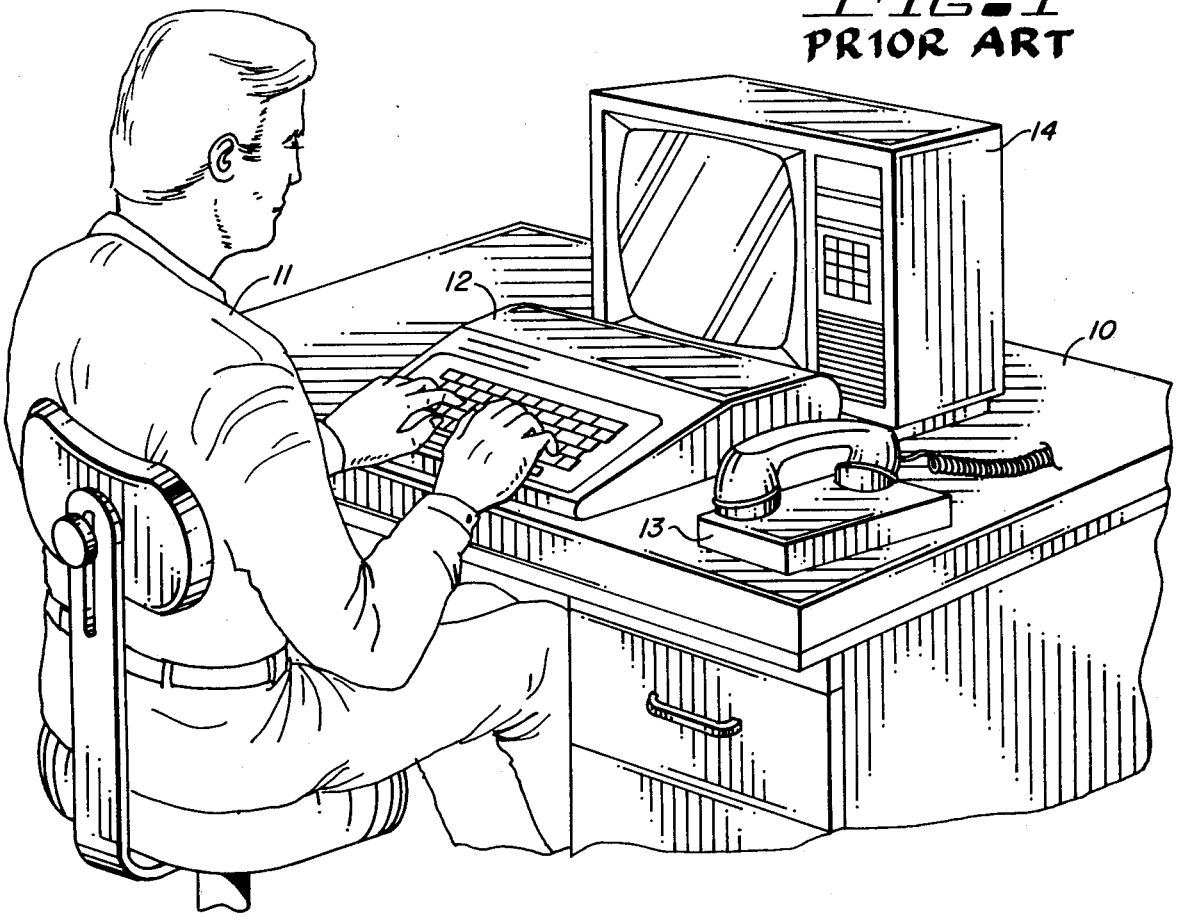
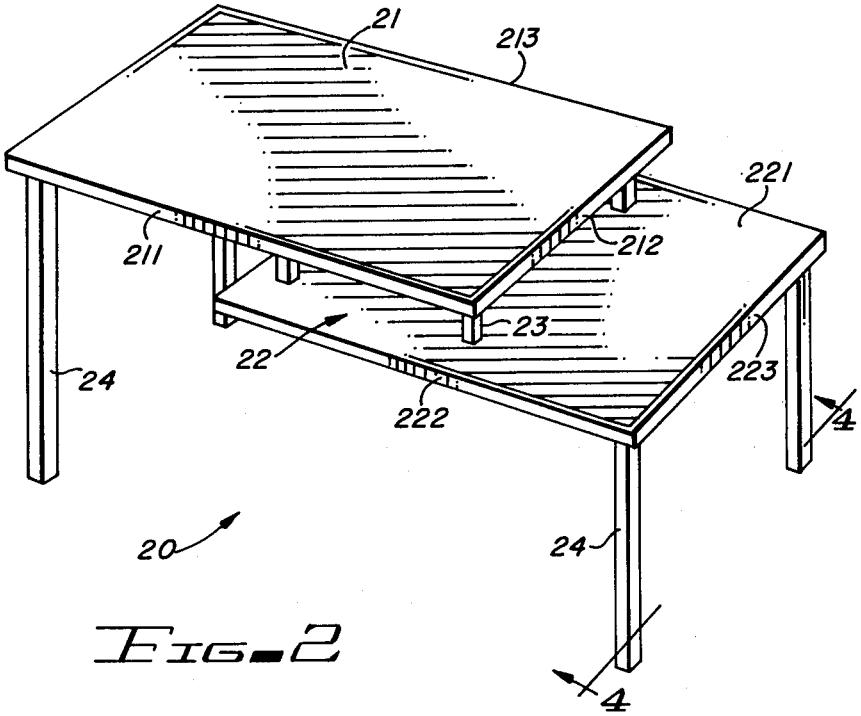
FIG. 2
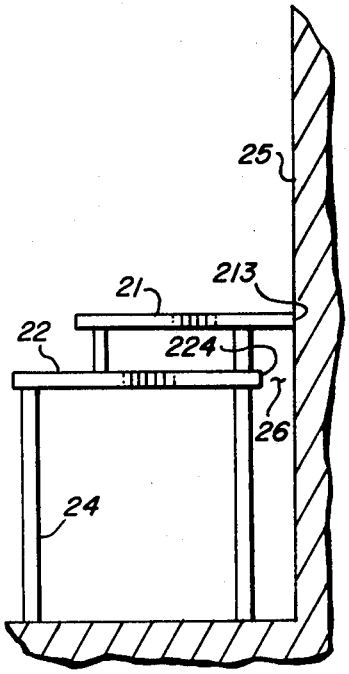
FIG. 4

COMPUTER DESK

BACKGROUND

1. Field of the Invention

The invention relates to furniture generally configured to use as desks. Specifically, the invention relates to a desk adapted for use with computer keyboard terminal equipment. Most specifically, the invention relates to a desk wherein the working surface of the desk top is preserved and usable access to a computer keyboard terminal is available to such a terminal supported by such a desk.

2. Prior Art

The computer is exerting a pervasive influence in the home and in small business establishments today. Originally only large businesses could afford the convenience of an on-premise computer. However, with the startling advances in technology which have been made in recent years, computers of small size and relatively reasonable costs are available to the small businessman and to individuals for use in their homes. When a computer is brought into the home or into a small business establishment, it is quite typical to find the various computer peripheral devices emplaced atop the working surface of conventional desks, tables and the like. With the computer devices so emplaced, the user is denied access to the working space normally provided by the desk or table top. Another disadvantage of such an arrangement is that the desk top is nominally at a height which supports computer keyboard terminals at an inconvenient height for comfortable typing.

Industry makes use of specialized work structures such as the data processing work station disclosed in Display patent, U.S. Pat. No. 253,445. Such a work station is highly specialized and is illusuited for use in the home or a business office.

Adding machines were a rudimentary form of today's calculators. Wege, in U.S. Pat. No. 1,827,128 issued Oct. 13, 1931, provided a calculator desk which sought to support an adding machine at a working height which was convenient for the operator. He removed a section of the working surface of a desk top and effectively located the removed section in a new plane below its original location. This provided a support surface at a lowered position for the adding machine and made the keyboard more handily accessible to the user. However, removal of the section of the working surface of the desk top resulted in a net decrease in the working surface available to the user.

Like Wege, Reed in U.S. Pat. No. 1,849,726 issued Mar. 15, 1932, provides a lowered working surface to bring a card punch machine down to a convenient working height. Once more, there is a significant loss in the available working surface of the desk top which lies in a plane above the surface on which the card punch machine rests.

Similar comments may be made with the stenographer's desk of Deaton, U.S. Pat. No. 2,793,926 issued May 28, 1957 and of the table of Blevins, U.S. Pat. No. 3,034,841 issued May 15, 1962.

Schreyer in U.S. Pat. No. 3,338,647 issued Aug. 29, 1967 discloses a desk which preserves the desk top working area by extending the desk length by adding thereto a lowered working surface on which a typewriter or the like may be situated at a convenient working height. The user of the desk need only slide his chair from one side to the other depending upon whether he wishes to make use of the desk top working surface or of the machine located on top of the lowered working surface. Unfortunately however, this results in inefficient use of the area beneath these working surfaces since it is necessary to provide knee space under both the desk top working surface and under the machine support surface.

Several desk designs have been derived in an effort to obtain additional working space on top of a desk. Typical of such attempts is U.S. Pat. No. Des. 161,959 issued to Park on Feb. 13, 1951 and Pat. No. D-57,075 issued to Fox on Feb. 8, 1921. Park provides a raised countertop above and to the rear of the desk top working surface. This raised counter is suitable for storage of books and papers but is not readily accessible as a working space to the user of the desk. Its availability, however, does permit the user to preserve handy access to various papers, books, catalogs and the like while leaving the working surface of the desk open and available. The working surface of the desk top, however, appears to be at conventional desk top height and would therefore be at an inconvenient height for use with a keyboard machine or the like. The Fox design modifies a conventional desk by mounting thereon a tee-shaped counter above the conventional desk top working surface. It would appear that this modification would make the desk awkward for one attempting to sit at the desk in the conventional manner. The raised countertop above the knee hole section is significantly higher than conventional desk tops. The desk top working surface to either side of the raised counter, that is to the left and the right of the knee hole space, is unavailable since there is no knee space beneath these surfaces. The conventional desk top work surface above the knee hole space is not available to the seated user except for the possible storage of paper or the like.

None of the known prior art permits the use of a manually operated device such as a computer keyboard terminal without sacrificing desk top working space.

It is therefore an object of the present invention to provide a computer desk which preserves desk top work space while providing for support of and usable access to a computer keyboard terminal.

It is a further objective of the invention to provide a computer desk which will support a computer keyboard terminal at a convenient working height for a user seated at such desk while preserving the desk top working space undiminished by the computer keyboard terminal.

It is a specific objective of the invention to provide a computer desk which makes efficient use of the desk top work space, which desk may be utilized for the support of computer devices in an efficiently useful, eye appealing arrangement.

SUMMARY OF THE INVENTION

A computer desk is disclosed which permits the use of a computer keyboard terminal while preserving desk top working space. The computer desk is comprised of a desk top work surface and means for fully supporting a computer keyboard terminal immediately below said desk top work surface. The support means is such as to provide convenient, usable access to a keyboard terminal so supported. The means for supporting a keyboard terminal immediately below the desk top work surface is comprised of a support surface which is coupled below the desk top work surface a distance sufficient to provide space between the two surfaces for a computer keyboard. The edge of the support surface is advanced toward the user seater at the computer desk so that the keys on the keyboard are in a covenient location to be seen and manually manipulated by a user seated at the desk. A preferred embodiment of the computer desk provides an extension of the support surface to one side of the user. This extended support surface permits additional computer peripheral devices be utilized with the computer desk while still preserving the desk top working space. Storage means are provided beneath the desk top work surface and the support surfaces at either side of the knee hole space provided for a user of the desk to provide storage for materials and devices useful to such a user. Where the extended support surface is utilized to support a computer printer terminal, such storage means may be utilized to provide active storage for paper being used by said computer printer terminal.

In a preferred embodiment of the invention, means are provided for easy passage of wiring from the computer devices supported by said computer desk to electrical outlets. Such easy passage of wiring is especially desirable when the desk is placed flush with the wall of the room in which the desk is located.

DESCRIPTION OF THE DRAWINGS

FIG. 1 illustrates the prior art utilization of a conventional desk as the support means for computer terminal equipment.

FIG. 2 is a perspective view of the two principle surfaces comprising the invention: the desk top work surface and the computer terminal support surface.

FIG. 4 illustrates the convenient wiring passageway which exists when the desk of FIG. 2 is located against the wall of the room in which the desk is located.

DETAILED DESCRIPTION OF THE INVENTION

Figure 3:
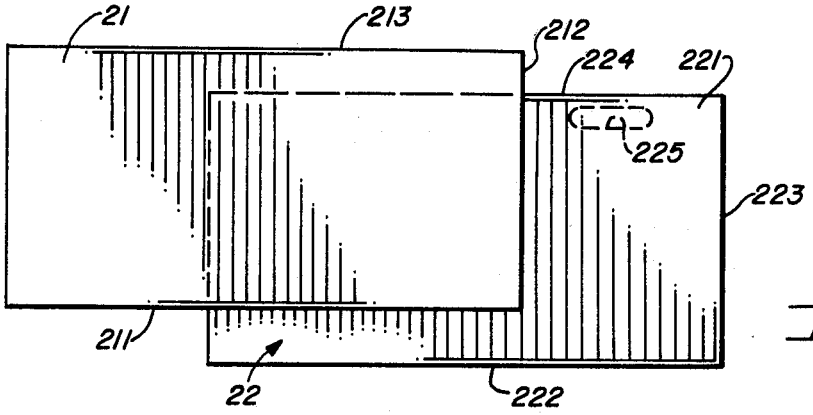
FIG. 3 is a plan view of the top of the two surfaces depicted in FIG. 2 illustrating the extension of the support surface toward the user so as to permit ready access to the keyboard of computer keyboard terminal devices supported on the support surface.

The manner in which conventional desks are adapted for use as computer desks is illustrated in FIG. 1. The user 11 sits at desk 10 for purposes of manipulating the keys of computer keyboard terminal 12 and viewing an alpha-numeric display on CRT display 14. If desired, a telephone modem 13 may be utilized to provide communication to a central data bank such as that made available by commercial computer services.

It will be noted that the desk top work surface normally available to user 11 is occupied by keyboard computer terminal 12 and telephone modem 13. Thus, no room is available for papers and other materials which may have to be relied upon in the course of communicating with the computer. It should be further noted that the height of the conventional desk top is higher than desirable for comfortable operation of the keys of the keyboard terminal 12. Typing tables or desks, which would place the keyboard 12 at a convenient height, do not, in general, provide sufficient surface area at the top of the table or desk to permit placement of the CRT display 14 on the typewriter table with the computer keyboard terminal 12.

The elementary concepts of the computer desk of the invention herein disclosed are illustrated in FIGS. 2–4. The computer desk 20 of the invention is comprised of a desk top work surface 21 and a support surface 22 coupled below the desk top work surface 21 by coupling means 23 which may, for example, be screw fastened rod supports. The height of supports 23 is sufficient to permit a computer keyboard terminal 12 to be inserted within the space provided between desk top work surface 21 and support surface 22.

Figure 5:
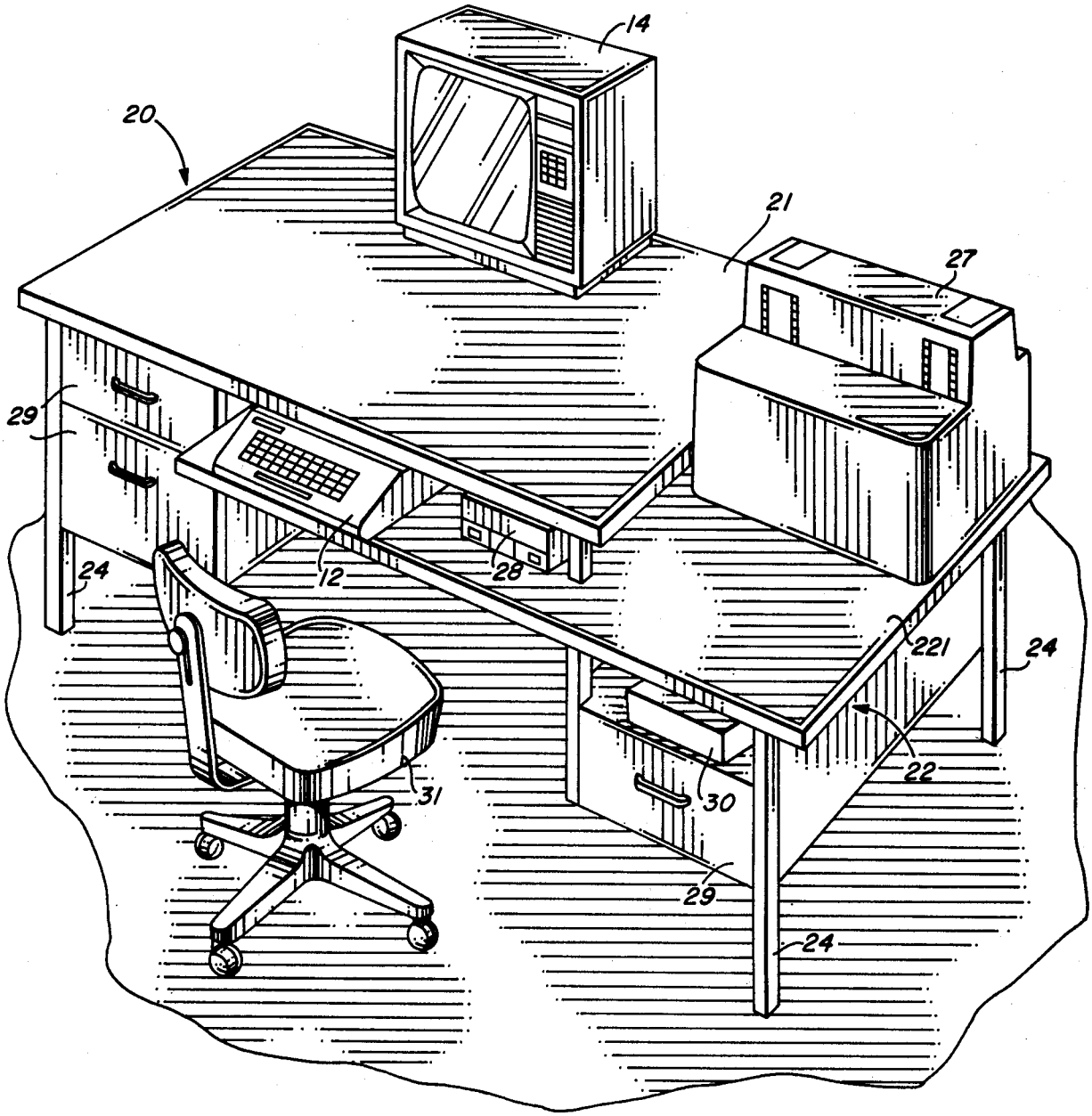
FIG. 5 is a perspective view of a preferred embodiment of the computer desk illustrating the clear working area preserved on the desk top and the provision for support of computer terminal equipment such as a disc storage device, a keyboard terminal and a printer.

It is important to note that the front edge 222 of support surface 22 is advanced closer to the user of the desk than is the front edge 211 of desk top work surface 21. This extension of support surface edge 222 toward the user permits ready access to the keys of computer keyboard terminal 12 without interference from desk top work surface 21. This latter advantage is best illustrated in FIG. 5.

Side edge 223 of support surface 22 could be essentially in line with side edge 212 of desk top work surface 21. However, extending support surface 22 to the side (to the right as illustrated in FIG. 2) so as to extend side edge 223 significantly beyond side edge 212 has the advantage of providing additional support surface for computer peripheral devices while preserving the availability of the desk top work surface 21. In addition, the extension 221 of support surface 22 makes it possible to provide storage means beneath support surface extension 221 without interfering with the lower extremities of a user seated at the computer desk 20. The addition of such storage means is illustrated in FIG. 5.

Supports 24 maintain desk top work surface 21 and support surface 22 at a desired height above the floor. As is seen in FIG. 5, supports 24 may form a part of storage means such as drawers 29 and paper storage 30.

It is frequently desirable or necessary to place a desk so that its rear edge 213 is maintained in flush contact with the wall of the room in which the desk is installed. Such an arrangement can raise problems with the distribution of wires from the various computer components to a source of power. To provide an easy passageway for wiring, an opening 225 may be provided through support surface 22. Opening 225 will be of sufficient size to permit the passage of wiring and associated connectors.

An alternative method for providing easy passage for wiring without having to make provision for openings such as 225 in support surface 22 is best illustrated in FIGS. 3 and 4. Here, the rear edge 213 of desk top work surface 21 is extended beyond the rear edge 224 of support surface 22. The extension of rear edge 213 is away from the user seated at the desk and toward the wall against which the desk is placed in flush contact. Thus, as seen in FIG. 4, when rear edge 213 of desk top work surface 21 is in flush contact with wall 25, a passageway 26 remains between rear edge 224 of support surface 22 and wall 25. Wiring from computer devices supported by support surface 22 may be easily fed through the void 26. If a CRT display 14 is emplaced atop desk top work surface 21, it can be placed in close contact with wall 25 so as to preserve the conventional working area of desk top work space 21. The wiring from CRT 14 may be brought over the edge 212 of desk top work surface 21 and down through passage 26 so as to achieve easy access to a source of power.

An embodiment of the invention having an extended support surface 221 and storage means comprised of drawers 29 and paper storage 30 is illustrated in FIG. 5. A computer keyboard terminal 12 is emplaced on support surface 22. The space between desk top work surface 21 and support surface 22 is of sufficient volume to permit a disk memory 28 to be incorporated within the space in a manner which does not interfere with the operation of keyboard terminal 12 but which makes ready access to disk memory 28 available to a user seated at chair 31. A CRT display 14 has been emplaced atop desk top work surface 21. It is noted that all of the conventional working area of a desk top work surface is preserved in the embodiment illustrated in FIG. 5 with the computer devices arranged as illustrated. Extension 221 of support surface 22 provides support for a computer printer 27. As part of the means 24 for supporting desk top work surface 21 and support surface 22 above the floor, storage means comprised of drawers 29 and paper storage 30 have been provided. Paper for printer 27 may be fed through openings such as 225 in support surface 22 or, alternatively, fed through passageway 26. A filing tray (not shown) emplaced behind printer 27 and also supported by support surface 22 may be utilized to accept the paper output by printer 27. Drawers 29 provide storage for various materials and devices which will be of use to the user of the computer desk. As is seen in FIG. 5, a user seated at chair 31 will have the keys of computer keyboard terminal 12 at a convenient working height for easy manipulation. The extension of support surface 22 toward a user seated in chair 31 prevents desk top work surface 21 from interfering with the user's access to the keys of keyboard terminal 12. In addition, the extension of support surface 22 toward the user does not interfere with the normal posture assumed by a user seated at chair 31 before a desk and employing the work surface atop the desk. In the invention, the extension of work surface 22 falls just above, or approximately at, the hip line of a person seated at chair 31. When a person is seated in a chair 31 before a desk 20, he naturally bends from the hips to bring his torso into comfortable position to perform work on the desk top working surface 21. This natural tendency to bend the body forward permits the extension of support surfaced 22 toward the user without interference of the user's body or causing any discomfort.

It may be noted here that the illustration of FIG. 1 was adapted from the *Midwinter Sale Catalog Number* 334, published February 1981 by Radio Shack, a division of Tandy Corporation of Forth Worth, Tex. It is submitted that the computer desk disclosed herein provides a more eye-pleasing, efficient utilization of desk top work space than that which results from the approach presently taken by user's of desks and computer equipment in the typical arrangement shown in the aforementioned catalog.

What has been disclosed is a desk which may be utilized with computer keyboard terminal equipment or other devices requiring manual manipulation by a user. The desk permits the efficient support of such devices without sacrifice of the desk top working surface available to the user. The computer desk provides a support surface immediately below the work surface of the desk top. This support surface extends toward the desk-user a greater distance than does the desk top work surface. Thus, there is no interference between the desk top work surface and the user's access to equipment emplaced upon the support surface. An extension of the support surface to the side provides additional support areas for associated computer devices or the like without sacrifice of desk top work surface area. Storage areas beneath the desk top work surface and the support surface have been provided to store materials and devices of use to a user of the computer desk.

Those skilled in the art will draw from the teachings herein and conceive of other embodiments of the invention other than those illustrated and disclosed herein. It is intended that all such embodiments so drawn shall fall within the ambit of protection provided by the claims appended hereto.

Having described my invention in the foregoing specification and illustrations in such clear and concise manner that those skilled in the art will readily understand and be enabled to easily practice it, that which I claim is:

1. A computer desk for use with a computer, keyboard terminal, and peripherial devices while preserving a clear desk top work space comprising:

an unencumbered horizontal planar desk top work surface;

means for emplacing and fully supporting a computer, keyboard terminal, and peripherial devices directly below said desk top work surface comprising a support surface coupled below said desk top work surface a distance sufficient to provide support for a computer, keyboard terminal, and peripherial devices between the two surfaces; and said desk top work surface and said support surface each comprises an edge nominally facing a user seated at said desk and said edge of said support surface is advanced toward said user to permit support of a computer, keyboard terminal, and peripherial devices while providing convenient usable access to the keyboard of a terminal so emplaced and supported unimpeded by said desk top work surface.

2. The computer desk of claim 1 wherein said desk top work surface and said support surface each comprises a side edge nominally to one side of a user seated at said desk and said side edge of said support surface is extended beyond said side edge of said desk top work surface to provide an additional area of support for computer peripheral devices while preserving the desk top working space unencumbered.

3. The computer desk of claim 2 further comprising means for supporting said desk top work surface a convenient height above a floor such that a user seated at said desk may conveniently make use of the unencumbered space provided by said desk top work surface and have easy access to the keyboard of a computer keyboard terminal supported on said support surface unimpeded by said desk top work surface.

4. The computer desk of claim 3 wherein said means for supporting said desk top work surface a convenient height above a floor further comprises storage means for providing accessable storage of materials and devices useful to the user of said computer desk.

5. The computer desk of claim 4 wherein said storage means further comprises means for active storage of paper used by a computer printer terminal when such a printer terminal is supported on said additional area of support provided by the extension of said side edge of said support surface.

6. The computer desk of claim 5 further comprising means for easy passage of wiring from computer devices supported by said desk to electrical outlets when said desk is placed flush with a wall.

7. The computer desk of claim 6 wherein said means for easy passage of wiring comprises openings in said support surface through which wiring and associated connectors may be passed.

8. The computer desk of claim 7 wherein said desk top work surface and said support surface each comprise a rear edge on a side nominally away from a user seated at said desk and said rear edge of said desk top work surface is extended away from said user such that when said rear edge of said desk top work surface is placed flush with a wall said means for easy passage of wiring comprises a void between said rear edge of said support surface and the wall.

* * * * *

UNITED STATES PATENT AND TRADEMARK OFFICE

CERTIFICATE OF CORRECTION

PATENT NO. : 4,449,762

DATED : 22 May 1984

INVENTOR(S) : Jeffrey A. Turner

It is certified that error appears in the above-identified patent and that said Letters Patent are hereby corrected as shown below:

Claim 1 should read as follows with the bracketed commas deleted:

1. A computer desk for use with a computer[,] keyboard terminal, and peripheral devices while preserving a clear desk top work space comprising:

an unencumbered horizontal planar desk top work surface;

means for emplacing and fully supporting a computer[,] keyboard terminal, and peripheral devices directly below said desk top work surface a distance sufficient to provide support for a computer[,] keyboard terminal, and peripheral devices between the two surfaces; and said desk top work surface and said support surface each comprises an edge nominally facing a user seated at said desk and said edge of said support surface is advanced toward said user to permit support of a computer[,] keyboard terminal, and peripherial devices while providing convenient usable access to the keyboard of a terminal so emplaced and supported unimpeded by said desk top work surface.

Signed and Sealed this

*Eleventh* Day of *December 1984*

[SEAL]

*Attest:*

GERALD J. MOSSINGHOFF

*Attesting Officer*

*Commissioner of Patents and Trademarks*